US010563563B2

(12) United States Patent
Son

(10) Patent No.: US 10,563,563 B2
(45) Date of Patent: Feb. 18, 2020

(54) COOLING CIRCUIT FOR VEHICLES

(71) Applicants: HYUNDAI MOTOR COMPANY, Seoul (KR); KIA MOTORS CORPORATION, Seoul (KR)

(72) Inventor: Ji Na Son, Hwaseong-Si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/033,547

(22) Filed: Jul. 12, 2018

(65) Prior Publication Data

US 2019/0120118 A1 Apr. 25, 2019

(30) Foreign Application Priority Data

Oct. 25, 2017 (KR) ..... 10-2017-0139022

(51) Int. Cl.
*F01P 3/20* (2006.01)
*F01P 3/18* (2006.01)
*F01P 5/10* (2006.01)

(52) U.S. Cl.
CPC ..... *F01P 3/20* (2013.01); *F01P 3/18* (2013.01); *F01P 5/10* (2013.01); *F01P 2003/182* (2013.01); *F01P 2050/24* (2013.01); *F01P 2050/30* (2013.01); *F01P 2060/02* (2013.01); *F01P 2060/045* (2013.01)

(58) Field of Classification Search
CPC ..... F01P 3/20; F01P 3/18; F01P 5/10; F01P 2060/045; F01P 2060/02; F01P 2003/182
See application file for complete search history.

(56) References Cited

U.S. PATENT DOCUMENTS

| | | | | |
|---|---|---|---|---|
| 7,649,273 | B2 | 1/2010 | Zillmer et al. | |
| 2012/0048504 | A1* | 3/2012 | Park | B60H 1/00778 165/41 |
| 2015/0217622 | A1* | 8/2015 | Enomoto | B60H 1/00878 165/42 |

FOREIGN PATENT DOCUMENTS

| | | | |
|---|---|---|---|
| JP | 4103887 | B2 | 6/2008 |
| JP | 2010-090729 | A | 4/2010 |
| JP | 2014-083918 | A | 5/2014 |
| JP | 2014083918 | A * | 5/2014 |

* cited by examiner

*Primary Examiner* — Jacob M Amick
*Assistant Examiner* — Charles Brauch
(74) *Attorney, Agent, or Firm* — Morgan, Lewis & Bockius LLP

(57) ABSTRACT

A cooling circuit for a vehicle includes: an electronic device disposed on a sub-water-cooling line; an intercooler disposed in parallel with the electronic device on the sub-water-cooling line; and a sub-radiator disposed on the sub-water-cooling line and configured to cool cooling water which passes through the electronic device and the intercooler before passing through the sub-radiator.

6 Claims, 1 Drawing Sheet

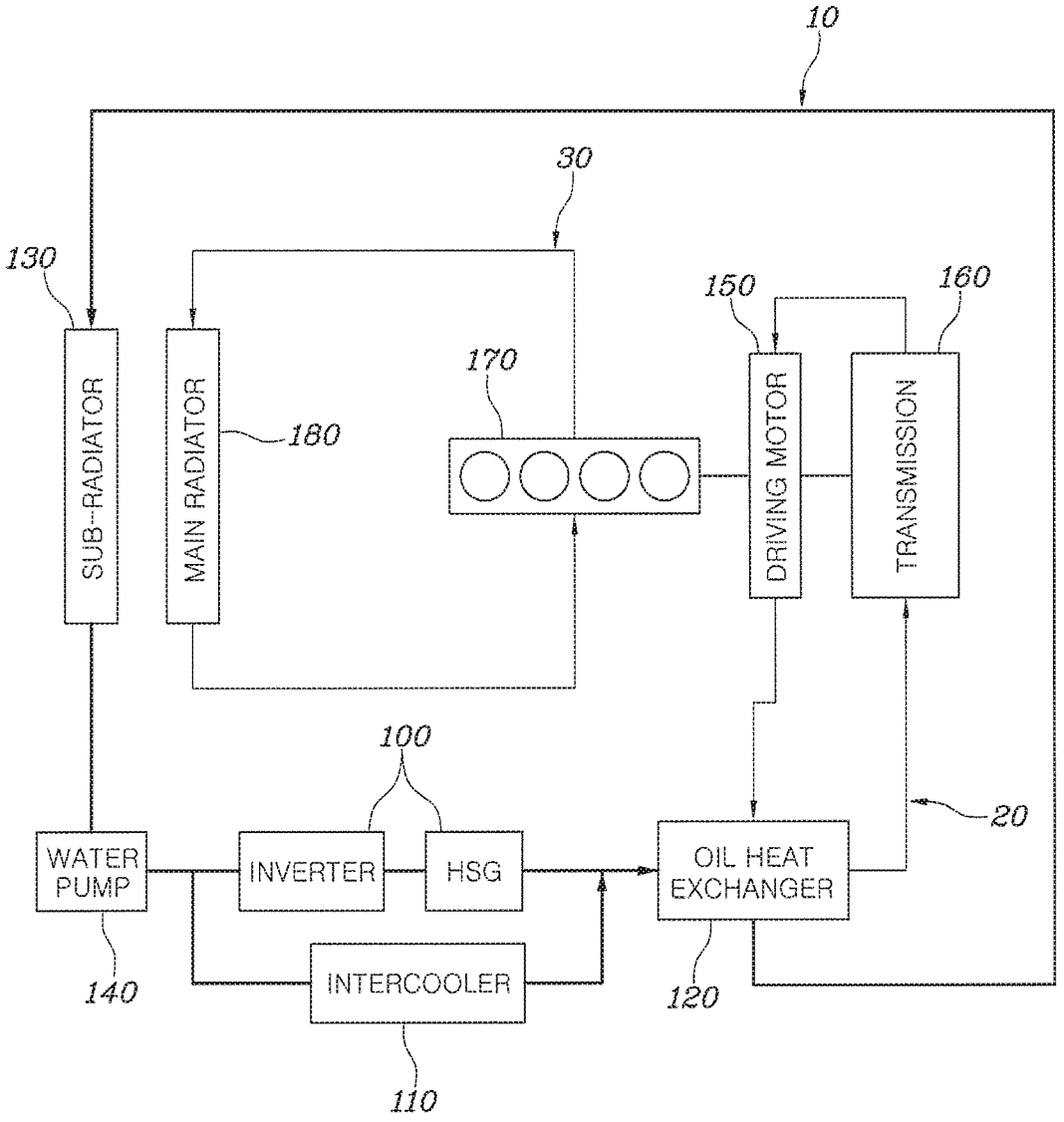
10
30
130
150
160
170
180
SUB-RADIATOR
MAIN RADIATOR
DRIVING MOTOR
TRANSMISSION
100
20
WATER PUMP
INVERTER
HSG
OIL HEAT EXCHANGER
INTERCOOLER
140
120
110

COOLING CIRCUIT FOR VEHICLES

CROSS REFERENCE TO RELATED APPLICATION

The present application claims the benefit of priority to Korean Patent Application No. 10-2017-0139022, filed Oct. 25, 2017, the entire contents of which is incorporated herein for all purposes by this reference.

TECHNICAL FIELD

The present disclosure relates to a cooling circuit for a vehicle capable of improving fuel efficiency by quickly increasing temperature of automatic transmission fluid (ATF) by improving an arrangement structure of water-cooled electronic devices, a water-cooled intercooler, and a motor.

BACKGROUND

An automatic transmission fluid (ATF) is oil that is used as a working oil of an automatic transmission. The ATF is not only used as a working fluid, but also used for lubricating and cooling.

However, the ATF has high viscosity in the early stage of cold start or in a low-temperature environment, so that power can be lost and fuel efficiency can be significantly reduced due to internal friction and line resistance. Further, a control valve, etc. may not likely to smoothly operate, and thus, a shifting shock or poor shifting is caused.

The foregoing is intended merely to aid in the understanding of the background of the present disclosure, and is not intended to mean that the present disclosure falls within the purview of the related art that is already known to those skilled in the art.

SUMMARY

An object of the present disclosure is to provide a cooling circuit for a vehicle, the cooling circuit improving fuel efficiency by quickly increasing temperature of ATF by improving the arrangement structure of water-cooled electronic devices, a water-cooled intercooler, and a motor.

According to an exemplary embodiment of the present disclosure, a cooling circuit for a vehicle includes: an electronic device disposed on a sub-water-cooling line; an intercooler disposed in parallel with the electronic device on the sub-water-cooling line; and a sub-radiator disposed on the sub-water-cooling line and configured to cool cooling water which passes through the electronic device and the intercooler before passing through the sub-radiator.

An oil heat exchanger may be disposed after a point where cooling water that has passed through the electronic device and cooling water that has passed through the intercooler converge.

The sub-radiator may be disposed before a point where cooling water is separated to the electronic device and the intercooler.

The cooling circuit may further include a water pump disposed on the sub-water-cooling line to circulate cooling water, in which the water pump may be disposed between a sub-radiator and the point where cooling water is separated to the electronic device and the intercooler, and the sub-radiator may be disposed between the oil heat exchanger and the water pump.

When plurality of electronic devices is provided, the electronic devices may be arranged in series.

The oil heat exchanger may be disposed on an oil cooling line, and a transmission and a driving motor may be disposed and cooled on the oil cooling line.

The cooling circuit may further include a main water-cooling line on which a main radiator is disposed to cool cooling water that has passed through an engine, in which the sub-water-cooling line and the main water-cooling line may be configured independently from each other.

According to the present disclosure, when a vehicle is driven in a very low-temperature environment, the ATF is heated by the heat generated by the electronic devices in an EV mode, and the ATF is heated by the heat generated by the intercooler and the driving motor in an engine mode, so that the fuel efficiency is improved by the increase in temperature of the ATF.

Further, since the electronic device and the intercooler are arranged in parallel and the oil heat exchanger is also disposed on the sub-water-cooling line, there is no need for additional cooling lines for separately cooling the components, so the manufacturing cost and weight of the cooling circuit are reduced.

BRIEF DESCRIPTION OF THE DRAWINGS

The above and other objects, features and other advantages of the present disclosure will be more clearly understood from the following detailed description when taken in conjunction with the accompanying drawings, in which:

FIG. 1 is a diagram showing an example of a cooling circuit for a vehicle according to an embodiment of the present disclosure.

DETAILED DESCRIPTION

Exemplary embodiments of the present disclosure are described hereafter in detail with reference to the accompanying drawings.

FIG. 1 shows an example of a cooling circuit for a vehicle according to an embodiment of the present disclosure and the cooling circuit may include electronic devices 100, an intercooler 110, and an oil heat exchanger 120.

First, the electronic devices 100, which may be disposed on a sub-water-cooling line 10, may include an inverter and a hybrid starter generator (HSG) that can generate power and start the engine of a hybrid vehicle, in which the inverter and the HSG may be arranged in series.

That is, the cooling circuit for a vehicle according to the embodiment of the present disclosure can be applied a hybrid vehicle that can be driven by torque from one of or both of an engine 170 and a driving motor 150, in which the electronic devices 110 may be water-cooled power electronic (PE) devices.

The intercooler 110 may be arranged in parallel with the electronic devices 100 on the sub-water-cooling line 10.

For example, two lines diverge before the electronic devices 100 on the line, in which electronic devices 100 may be disposed on one of the diverging lines and the intercooler 110 may be disposed on the other line. The intercooler 110 may be a water-cooled intercooler.

A sub-radiator 130 is provided to cool cooling water that has passed through the electronic devices 100 and the intercooler 100. The sub-radiator 130 may be disposed on the sub-water-cooling line 110.

For example, the sub-radiator 130 may be disposed before the point where cooling water diverges to the electronic devices 100 and the intercooler 110, and both of the electronic devices 100 and the water-cooled intercooler 110 may be cooled by the sub-radiator 130.

That is, the cooling water cooled through the sub-radiator 130 cools not only the electronic devices 100 such as an inverter and an HSG, but the intercooler 110 while flowing therethrough.

According to this configuration, since the present disclosure includes the cooling line having the electronic devices 100 and the intercooler 110 disposed in parallel, the components are cooled on one cooling line. Accordingly, there is no need for an additional cooling line for cooling the electronic devices 100 and the intercooler 110, so unnecessary costs and weight of the cooling circuit are reduced.

In particular, since the electronic device 100 and the intercooler 110 are arranged in parallel in the present disclosure, even though the temperature of cooling water is increased by heat generated by the electronic devices 100, the cooling water increased in temperature does not flow into the intercooler 110, so deterioration of cooling performance and efficiency of the intercooler 110 due to the heat generated by the electronic devices 100 is prevented.

Further, an oil heat exchanger 120 may be disposed after the point where the cooling water that has passed through the electronic device 100 and the cooling water that has passed through the intercooler 110 meet each other.

For example, the oil heat exchanger 120 can be disposed behind the point on which the two lines having the electronic devices 100 and the intercooler 110 converge.

The oil heat exchanger 120 may be an ATF (Automatic Transmission Fluid) cooler or an ATF warmer and the cooling water exchanges heat with the ATF.

That is, when a vehicle is driven in an EV mode, cooling water passes through the electronic devices 100 before it reaches the oil heat exchanger 120, so cooling water increases in temperature, but it can cool the ATF because the electronic devices 100 generate a small amount of heat.

However, when a vehicle is driven in an EV mode in a very low-temperature environment, the degree of an increase of temperature of the cooling water due to heat generated by the electronic devices 100 is relatively large in comparison to a normal driving environment, so the cooling water contributes to an increase in temperature of the ATF, whereby the temperature of the ATF is increased.

Further, even though a vehicle is driven in an engine mode, cooling waters converge after passing through the intercooler 110 disposed in parallel with the hybrid electronic devices and then cool the ATF.

In the engine mode, the amount of heat generated by the electronic devices 100 and the intercooler 110 is relatively large, but the temperature of the cooling water that has passed through the electronic devices 100 and the intercooler 110 is about 80° C. and the temperature of the ATF is about 120° C., so the ATF can be cooled by the cooling water.

However, when a vehicle is driven in the engine mode in a very low-temperature environment, the temperature of the cooling water is increased by the heat generated by the electronic devices 110 and the heat generated by the intercooler 110, so the temperature of the ATF may be increased.

On the other hand, a water pump 140 is disposed on the sub-water-cooling line 110, so the cooling water can be circulated.

For example, the water pump 140 may be an electric water pump and may be disposed between the sub-radiator 130 and the point where cooling water is separated to the electronic devices 100 and the intercooler 110. The sub-radiator 130 may be disposed between the oil heat exchanger 120 and the water pump 140.

That is, cooling water cooled through the sub-radiator 130 is cooled through the electronic devices 100 such as the HSG, inverter, and OPU (Oil Pump Unit) and can be circulated by the electric water pump 140.

In particular, according to the embodiment of the present disclosure, the OPU is continuously operated to circulate oil of a transmission even in the EV mode, so it generates heat. Accordingly, when the electric water pump 140 drives to cool the OPU, the ATF can be cooled by circulating the cooling water, so the power consumed by the water pump 140 to cool only the ATF can be minimized.

Meanwhile, according to the embodiment of the present disclosure, the oil heat exchanger 120 disposed on an oil cooling line 20, so it exchanges heat with the cooling water flowing through the sub-water-cooling line 10.

Further, the transmission 160 and the driving motor 150 are disposed on the oil cooling line 20 and are cooled by the transmission oil.

That is, the electronic devices 100 and the intercooler 110 are cooled by the cooling water flowing through the sub-water-cooling line 10, while the transmission 160 and the driving motor 150 are cooled by the transmission oil, whereby the cooling and the oil are cooled/heated by exchanging heat with each other through the oil heat exchanger 120, depending on the external temperature condition.

According to the embodiment of the present disclosure, there may be further provided a main water-cooling line 30 on which a main radiator 180 is disposed to cool the cooling water that has passed through an engine 170. Though not shown in the FIGURE, a water pump for circulating cooling water may also be disposed on the main water-cooling line 30.

In particular, the sub-water-cooling line 10 and the main water cooling line 30 are provided independently from each other. That is, the cooling water flowing through the sub-water-cooling line 10 and the cooling water flowing through the main water-cooling line 30 perform cooling while flowing through independent lines.

That is, since the present disclosure includes the main water-cooling line 30, the sub-water-cooling line 10, and the oil cooling line 20, the cooling water and oil that flow through respective cooling lines are cooled/heated by exchanging heat with each other, depending on the driving mode of a vehicle and the external air temperature condition.

For example, the external air temperature is high in an engine mode in which a vehicle is driven by the engine 170, the engine is cooled by the cooling water flowing through the main water-cooling line 30, the transmission 160 is cooled by the ATF flowing through the oil cooling line 20, and the intercooler 110 and the oil heat exchanger 120 are cooled by heat exchange between cooling water in the sub-water cooling line 10 and ATF through the oil heat exchanger 120.

Further, when the external air temperature is low in the engine mode, the cooling water used for cooling the intercooler 110 and the ATF exchange heat with each other through the oil heat exchanger 120, whereby the ATF is increased in temperature.

On the other hand, when the external air temperature is high in the EV mode in which a vehicle is driven by the driving motor 150, the driving motor 150 is cooled by the ATF, and the electronic devices and the oil heat exchanger 120 are cooled by the cooling water flowing through the sub-water-cooling line 10.

Further, when the external air temperature is low in EV mode, the cooling water used for cooling the electronic devices and the ATF exchange heat with each other through the oil heat exchanger 120, whereby the ATF is increased in temperature.

As described above, according to the embodiment of the present disclosure, when a vehicle is driven in a very low-temperature environment, the ATF is heated by the heat generated by the electronic devices in an EV mode, and the ATF is heated by the heat generated by the intercooler 110 and the driving motor 150 in an engine mode, so the fuel efficiency is improved by the increase in temperature of the ATF.

Further, since the electronic devices 100 and the intercooler 110 are arranged in parallel and the oil heat exchanger 120 is also disposed on the sub-water-cooling line 10, there is no need for additional cooling lines for separately cooling the components, so the manufacturing cost and weight of the cooling water of the cooling circuit are reduced.

On the other hand, although the present disclosure was described with reference to the detailed embodiments, it is apparent to those skilled in the art that the present disclosure may be changed and modified in various ways without the scope of the present disclosure and it should be noted that the changes and modifications are included in claims.

What is claimed is:

1. A cooling circuit for a vehicle, comprising:

an electronic device disposed on a sub-water-cooling line;

an intercooler disposed in parallel with the electronic device on the sub-water-cooling line;

a sub-radiator disposed on the sub-water-cooling line and configured to cool cooling water which passes through the electronic device and the intercooler before passing through the sub-radiator; and an oil heat exchanger disposed on the sub-water-cooling line downstream of a junction point where a path through which cooling water passes through the electronic device and a path through which cooling water passes through the intercooler intersect.

2. The cooling circuit of claim 1, wherein the sub-radiator is disposed on the sub-water-cooling line before a branch point where the sub-water-cooling line branches to the electronic device and the intercooler.

3. The cooling circuit of claim 2, further comprising a water pump disposed on the sub-water-cooling line to circulate cooling water, wherein the water pump is disposed between the sub-radiator and the branch point, and wherein the sub-radiator is disposed between the oil heat exchanger and the water pump.

4. The cooling circuit of claim 1, wherein when the electronic device is provided in plural, the plurality of electronic devices are arranged in series.

5. The cooling circuit of claim 1, further comprising an oil cooling line on which the oil heat exchanger is disposed, wherein a transmission and a driving motor are disposed and cooled on the oil cooling line.

6. The cooling circuit of claim 1, further comprising a main water-cooling line on which a main radiator is disposed to cool cooling water passing through an engine, wherein the sub-water-cooling line and the main water-cooling line are separated from each other.

* * * * *